US005529124A

United States Patent [19]

Hwan

[11] Patent Number: 5,529,124

[45] Date of Patent: Jun. 25, 1996

[54] METHOD FOR RETARDING WATER CONING

[75] Inventor: Rei-Nan R. Hwan, Sugar Land, Tex.

[73] Assignee: Texaco Inc., White Plains, N.Y.

[21] Appl. No.: 358,448

[22] Filed: Dec. 19, 1994

[51] Int. Cl.[6] ..... E21B 33/138; E21B 43/32

[52] U.S. Cl. ..... 166/294; 166/306

[58] Field of Search ..... 166/294, 305.1, 166/306, 313

[56] References Cited

U.S. PATENT DOCUMENTS

| | | | |
|---|---|---|---|
| 3,123,140 | 3/1964 | Connally, Jr. | 166/306 X |
| 3,308,885 | 3/1967 | Sandiford | 166/305.1 X |
| 3,386,514 | 6/1968 | Weber | 166/306 |
| 3,497,011 | 2/1970 | Weber et al. | 166/306 |
| 3,820,603 | 6/1974 | Knight et al. | 166/305.1 X |
| 3,826,311 | 7/1974 | Szabo et al. | 166/305.1 X |
| 3,830,302 | 8/1974 | Dreher et al. | 166/294 |
| 4,095,651 | 6/1978 | Chauveteau et al. | 166/294 |
| 4,147,211 | 4/1979 | Sandiford | 166/270 |
| 4,718,491 | 1/1988 | Kholer et al. | 166/294 |

OTHER PUBLICATIONS

"Polymer Flooding Technology–Yesterday, Today, and Tomorrow", *Journal of Petroleum Technology,* H. L. Chang, SPE–AIME, Cities Service Oil Co., Aug. 1978.

"Numerical Simulation Study of Water Shut–Off Treatment Using Polymers", R–N. R. Hwan, Texaco Inc., SPE 25854, Presentation–SPE Rocky Mountain Reg./Low Permeability Reservoirs Symposium, Denver, CO, USA, Apr. 12–14, 1993.

*Primary Examiner*—George A. Suchfield

*Attorney, Agent, or Firm*—Kenneth R. Priem; James L. Bailey; Harold J. Delhommer

[57] ABSTRACT

A method for retarding the effect of water coning during the production of oil from a subterranean formation is described. The retarding occurs by injecting into the subterranean formation, at or below the oil/water interface, a polymer solution having a viscosity at least twice that of the connate water to form a zone of high viscosity about the wellbore during the oil production.

6 Claims, No Drawings

METHOD FOR RETARDING WATER CONING

BACKGROUND

This invention relates to the improved oil recovery from subterranean reservoirs containing both water and oil through the control of this viscosity in the water.

BACKGROUND OF THE INVENTION

Sooner or later during the life of a producing oil field there comes a time when the presence of water in the subterranean formation results in the production of considerable quantities of water, most often in the form of brine, along with the oil. Production of excessive amounts of water cause wells, even fields, to become unprofitable. Many attempts have been made to retard to the production of water while increasing the quantity of oil removed from the formation.

An enhanced oil recovery process uses a displacing fluid injected into a reservoir to displace, push, oil through the formation to one or more spaced production wells through which the oil is produced. When there is an oil/water interface, and there always is, coning often results at the producing well. Coning occurs when, during production, the water level around the wellbore rises, thus effectively reducing the thickness of the oil producing formation. This phenomenon also occurs in situations where there is pump production from a well penetrating the formation where there is a pronounced oil/water interface.

In the practice of water flooding, for over thirty (30) years polymers have been injected into the formation in order to improve the water sweep efficiency by increasing the water viscosity. A history of this effort is discussed in an article, "Polymer Flooding Technology—Yesterday, Today, and Tomorrow," H. L. Chang, *Journal of Petroleum Technology*, August, 1978. In this article, even tomorrow is yesterday, and even with this wide range of information, the problem of water coning remains. Generally, two types of polymers are used: a) synthetic polymers such as, for example, polyacrylamide, usually at least partially hydrolyzed, or b) xanthan gums.

During the process of enhanced oil recovery, it is often been found that channelling would develop between injection wells and production wells, thus reducing the production efficiency. Of course, this most often occurs in heterogeneous reservoirs. One attempt to solve this problem is described in U.S. Pat. No. 4,147,211, which also involved the injection of polymers into zones of high permeability where channeling occurred in order to create a plug and reduce the ease by which fluid flow occurred between an injection well and production well bypassing pockets of valuable oil. The prior art patent discussed above involves the establishment of a zone of a silicate plugging composition situated around the perforations of casing in the wellbore to form a silicate plugging composition in the presence of a reacted gelling agent for the silicate. Still, the problem continues to persist. More recently attempts have been made to decrease the permeability of a reservoir matrix to passage of water while only slightly reducing its permeability to oil and reducing the coning of water during production through the injection of polymers. A discussion of computer simulation of this study is found in "Numerical Simulation Study of Water Shut-Off Treatment Using Polymers," R-N. R HWAN[1], SPE-Rocky Mountain Regional/Low Permeability Reservoirs Symposium, Denver, Colo., April 1993. This paper describes treatment of reservoirs with a polymer solution to only slightly reduce the permeability of oil while reducing the permeability to water to a greater extent. This paper also references publications regarding other attempts, largely futile, to ameliorate the coning problem. Even in the presence of viscosifying polymers causing viscosities of 100 centipoise or greater the problem persists. This requires a large concentration of about 1000 ppm polymer for a useful operation.

In the simulation discussion a "polymer" disc was injected at the oil-water contact point instead of the oil zone as discussed widely in the paper. For purposes of the simulation it was assumed that polymer discs were impermeable to the formation fluids which assumption was determined to be only partially correct.

Characteristically, the establishment of a polymer flood has involved polymer concentrations in the neighborhood of 1000 ppm with the requirement that the viscosity be materially increased to about 100 centipoise only to still leave the solution of coning problems relatively unaddressed.

Therefore, the problem of water coning during oil production from these water drive reservoirs persists and, in attempts to successfully develop the resources, prior art efforts leave much to be desired.

SUMMARY OF THE INVENTION

It is an object of this invention to provide a method to retard water production through the use of a polymer to enhance the production of oil from a borehole in an aquifer water-drive reservoir. This procedure accomplishes the primary objective of increasing the oil production and profitable reservoir life in the system.

The objects of this invention are accomplished by injecting into the water zone of an aquifer water-drive reservoir at or below the oil zone, a sufficient amount of a viscosifying polymer in an aqueous solution to raise the viscosity of the connate water in the reservoir by an amount at least twice that of the connate water initially, preferably of from about 10 to about 15 centipoise in viscosity. This method involves the injection of a solution containing from about 50 to about 100 ppm of a viscosifier in sufficient quantities to penetrate into the formation from the surface of the oil/water contact along the vertical axis of the wellbore, as a preferred embodiment for a vertical height of at least about 20 feet and to extend to a radius of from about 100 feet to about 200 feet from the wellbore.

The viscosifying material is either a biopolymer, such as, for example, a xanthan gum, in instances of high salinity connate water, or a synthetic polymer such as a polyacrylamide where low salinity connate water exists. The advantage of the low concentration injection is that the operator may inject a large volume of polymer solution at significant distances from the wellbore into the formation and at considerable depth from the interface with the oil to be produced without incurring ruinous expense required by high concentrations of viscosifier injection.

DETAILED DESCRIPTION OF THE INVENTION

The practice of this invention is most applicable to the recovery of oil from a single wellbore penetrating an oil-producing formation which is tending toward significant water production and is reducing the oil water production ratio. The practice of the invention involves injection of a polymer solution having a viscosity of at least about twice that of the connate water in the formation. This solution creates a zone of high viscosity around the periphery of the wellbore and is injected in sufficient quantity to preferably extend a radius of from about 100 feet to about 200 feet from the wellbore into the formation and at a vertical height of at least about 20 feet along the axis of the wellbore downward from the interface of the oil zone and water zone. It has been found that once this zone of higher viscosity is created, the susceptibility to water coning is greatly reduced and to relatively quiescent environment reduces shearing forces allowing the zone to maintain its integrity even though the viscosity is not particularly high. Those skilled in the art would be familiar with injection rates required to reduce the intimate mixing of the higher viscosity solution and the connate water in order that a relatively stable zone is established. Alternatively, the viscosity of the injected solution could be slightly higher than that of the final high viscosity zone to reduce dilution effects with the connate water found in the formation. Depending upon how the well is rigged, polymer injection to retard the coning may occur either before or during the production of oil from the oil zone. This is accomplished through the configuration of tubing and packers used in the well. By completing the well with injection tubing running to the water with a packer above the casing perforations in the water zone, production and injection may occur simultaneously, this even further reducing the water coning.

While polymer flooding requires solutions containing from about 250 ppm to about 1500 ppm of the viscosifier in the flood water, the viscosifying solution used in the present invention would normally contain from about 50 to about 100 ppm polymer in the aqueous solution to provide a viscosity in the formation at least about twice the viscosity of the connate water, preferably from about 5 to about 15 centipoise, most preferably from about 8 to about 12 centipoise. Therefore, an easy determination can be made as to how much to add by testing the connate water of the formation to determine the salinity in the formation so that proper selection of viscosifying agent as discussed hereinafter can be made. The desired increase in viscosity would be about twice that of the connate water, preferably or from about 10 to about 15 centipoise, for a useful rule of thumb. Once the solution is injected into the formation in a sufficient amount to form a high viscosity zone of water around the wellbore penetrating the oil producing formation to a radius of preferably of about 100 feet to about 200 feet and a height along the axis of the wellbore of from about 15 to about 25 feet, preferably about 20 feet. Greater or lesser distances may be used depending upon the circumstances of the production formation. By installing the higher viscosity zone below the interface of the oil and water the amount of water lifted during production of the oil would be reduced since such lifting would be resisted by the forces in the higher viscosity zone deterring any further water production. Of course, no injection of this type would last forever, but the use of such high viscosity water zones surrounding producing wells in such formation materially enhance the life of the formation and the recovery of important resources.

It is well known in the prior art that the polymer injection in the water flood situation involves much higher polymer concentrations and viscosity increases of 300 centipoise are not uncommon.

As is well known to those involved in the production of oil from subterranean zones through a wellbore, there are many physical factors in a formation which affect the treatments made and the production of petroleum products. It is no different in the practice of this invention since, as well known, the selection of polymers for the prior art polymer flooding has been dictated in large part by the salinity and temperature of the connate water in the formation. Thus, the selection of the viscosifier in the practice of the present invention must be dictated by these same criteria. High salinity requires a biopolymer such as, for example, a xanthan gum, and low salinity would dictate that a polyacrylamide would be necessary.

Exemplary water-soluble polymeric materials for use in low-salinity are relatively high molecular weight acrylic acid-acrylamide copolymers, polyacrylamides, partially hydrolyzed polyacrylamides, polyalkyleneoxides, carboxyalkycelluloses, hydroxyethylcelluloses, alkali metal lignosulfonates and heteropolysaccharides obtained by the fermentation of starch-derived sugar.

Many of the water soluble polymers useful in the practice of this invention are characterized by a viscosity of at least 3 centipoises for a 0.1 percent by weight solution thereof in aqueous 3 percent by weight sodium chloride solution at 25° C. as determined with a Brookfield viscometer equipped with a UL adapter and operated at a speed of 6 rpm. However, it is to be recognized that other of the water-soluble polymers, such as certain polyacrylamides and polyalkyleneoxides, are effective in reducing the mobility of water in porous media, yet have little or only slight effect upon the viscosity of water or brine.

The polyacrylamide and partially hydrolyzed polyacrlyamide which can be used in this invention include the commercially available, water soluble, high molecular weight polymers having molecular weights in the range of above about $0.2\times10^6$ , preferably from $0.5\times10^6$ to $40\times10^6$ and more preferably from about $3\times10^6$ to about $10\times10^6$. The hydrolyzed polyacrylamides have up to about 70 percent of the carboxamide groups originally present in the polyacrylamide hydrolyzed to carboxyl groups. Preferably from about 12 to about 45 percent of the carboxamide groups are hydrolyzed to carboxyl groups. Hydrolysis of the acrylamide polymers is well known and the description of U.S. Pat. No. 4, 147,211 is incorporated herein by reference for all purposes. The term "hydrolyzed polyacrylamide", as employed herein, includes of the modified polymers where the carboxyl groups are in the acid form and polymers where in the carboxyl groups are in the salt form, provided that the salts are water-soluble. A number of polyacrylamides and partially hydrolyzed acrylamide polymers and acrylic acid-acrylamide copolymers suitable for use in this invention are commercially available, for example, "WC-500" polymer marketed by Calgon Corporation of Pittsburgh, Pa., "Pusher" 700 polymer marketed by The Dow Chemical Company of Midland, Mich., and "Q-41" polymer marketed by Nalco Chemical Company of Oak Brook, Ill.

Especially useful in the practice of this invention are the at least partially cationic polyacrylamides, the at least partially anionic polyacrylamides and mixtures thereof. A partially cationic polyacrylamide is a non-ionic polyacrylamide which contains a cationic comonomer, such as an alkylene polyamine, a quaternary ammonium chloride or amine hydrochloride, for example, trimethyl octyl ammonium chloride, trimethyl stearyl ammonium chloride, oleyl trimethyl ammonium chloride, oleyl amine diethylamine hydrochloride and dimethylamineopropylamine. A partially anionic polyacrylamide can be a nonionic polyacrylamide which has been partially hydrolyzed to convert some of the acrylamide groups to acrylic groups, to alkali metal salts of which are anionic. Introducing sulfate or sulfonate groups into the polyacrylamide molecule also imparts an anionic character to the molecule. "WD-120" copolymer is a 20 percent by weight cationic, 80 percent nonionic copolymer marketed by Betz Laboratories, Inc. of Trevose, "Pa. WD-160" polymer and "Hi Vis " polymer are 40 percent anionic, 60 percent nonionic polyacrylamides which have been partially hydrolyzed to the extent of 35 percent. These polymers are also marketed by Betz Laboratories, Inc.

Water-soluble hydroxyethylcellulose useful in this invention has a substitution (hydroxyethyl groups per glucose unit) greater that about 0.5, and preferably from 1.0 to 2.0.

The biopolymers which may be used in carrying out the present invention in high salinity environments are ionic polysaccharides produced by fermentation of carbohydrates by bacteria of the genus Xanthomonas, thus the name "xanthan gum". Examples of such heteropolysaccharides are those produced by *Xanthomonas campestris, Xanthornonas begonia, Xanthomonas phaseoil, Xanthomonas hederae, Xanthomonas incanae, Xanthomonas carotae* and *Xanthomonas translucens*. Of these, ionic polysaccharide B-1459 is preferred. The polysaccharide B-1459 is prepared by culturing the bacterium *Xanthomonas campestris* NRRL B-1459, U.S. Department of Agriculture, on a well-aerated medium containing commercial glucose, organic nitrogen sources, dipotassium hydrogen phosphate and various trace elements. Fermentation is carried to completion in four days or less at a pH of about 7 and a temperature of 28° C. Polysaccharide B-1459 is available under the trademark "Kelzan MF " marketed by Kelco Company of San Diego, Calif. Production of this heteropolysaccharide is well described in Smiley, K. L. "Microbiol Polysaccharides —A Review". *Food Technology,* 20, 9:112–116 (1966) and Moraine, R. A., Rogovin, S. P. and Smiley, K. L. "Kinetics of Polysaccharide B-1459 Synthesis", *J. Fermentation Technology* 44, 311–312 (1966).

The selected water-soluble polymer is admixed with water or brine in the amounts mentioned above to provide a relatively dilute aqueous solution of the polymer that exhibits a sufficiently reduced mobility when injected into the porous media displace the lesser viscous connate water and form the high viscosity zone about the wellbore. Care should be taken to avoid injection rates which may create excessive shearing forces. This, of course, will run according to the tubing size perforations and physical characteristics of the formation. Preferably, the polymer is dissolved in fresh water since the mobility reduction effect of most of these polymers in inhibited by the presence of substantial quantities of dissolved salts. However, it is sometimes desirable to employ oil-field brine or other water containing relatively high dissolved salt contents, particularly where the formation into which they are to be injected is water-sensitive or where fresh water is not available. In most instances, the mobility of the water can be reduced to the desired level by the addition of about 0.001 to about 1 weight percent of the polymer, and satisfactory results can often be obtained by the addition of 0.05 to 0.15 weight percent of polymer. While the injection of the water containing the polymer is in progress, production may occur from the oil zone in the wellbore. Of course, those skilled in the art would readily understand the various techniques to use for injection of the polymerized water solution into the formation depending upon the apparatus in the wellbore and the various configurations involved. As a preferred embodiment the viscosifying solution may be injected as above followed by an injection of water or brine deeper in the water zone to "lift" the high viscosity zone formed by the prior injection to place it at the oil zone interface. Normally the water injection would occur about 20 feet below the polymer injection point. When the production and either occur simultaneously it is preferred that they are close to the same rates to prevent any damage.

EXAMPLE

In order to demonstrate the improvement of instant invention a computer simulation was run using commercially available software (Western Atlas Software Inc.'s —VIP polymer model). The oil reservoir is modeled to have a bottom aquifer with the thickness of the oil zone being 100 ft. The casing of a single wellbore is perforated above the top 40 feet interval for oil production with a dual tubing completion. The well is perforated in the water zone for 20 feet below the interface between the oil zone and the water zone. The oil viscosity was about 10 centipoise with the water viscosity at about 0.31 centipoise. A polymer solution containing 100 ppm of a partially hydrolyzed polyacrylamide ("Pusher "700) is injected into the 20 feet below the oil/water interface having a viscosity of about 10 centipoise in the reservoir. The production rate of fluids from the oil zone is 2000 barrels per day. For simultaneous injection the flow rates are balanced.

The model program projected the production of this single well for a period of 10 years, both with and without the polymer injection. The cumulative production over the 10 year period of the well from polymer injection would be 111,000 barrels as compared with 69,000 barrels where production is taken from the natural aquifer-drive well. The model also demonstrated that oil production was most favorably enhanced if the polymer is injected prior to producing oil from the oil bearing formation. If the polymer solution viscosity in the formation is reduced to 1.1 cp, the oil production becomes 78,000 barrels as opposed to 69,000 barrels, still an improvement showing coning effect retarded.

Having described the instant invention above, those skilled in the art may make modifications and adjustments to such description and practice the advantages of the instant invention without departing from the scope of the appended claims.

I claim:

1. A method for retarding the effect of water coning during production of oil from a subterranean formation, penetrated by a wellbore, having an upper oil zone communicating through production tubing in the wellbore to surface facilities, and a water zone adjacent injection tubing which comprises:

injecting a sufficient amount of a solution containing from about 50 ppm to about 100 ppm of a viscosifying material through injection tubing in the wellbore into the water zone of a formation below the interface between the oil zone and the water zone to form a zone of viscous water having a viscosity of from about 5 to about 15 centipoise; at a radius from about 100 feet to about 200 feet from the wellbore at a height along the axis of the wellbore of from about 15 to about 25 feet, and producing the oil from the oil zone through production tubing.

2. The method of claim 1 wherein the viscosifying material is injected prior to the production of oil.

3. The method of claim 1 wherein the viscosifying material is a biopolymer to be used in the presence of brine.

4. The method of claim 1 wherein the viscosifying material is a polyacrylamide.

5. The method of claim 4 wherein the polyacrylamide is a partially hydrolyzed polyacrylamide having up to about 70% of the carboxymide groups hydrolyzed to carboxyl groups.

6. The method of claim 1 wherein the zone of viscous water has a viscosity of from about 8 to about 12 centipoise.

* * * * *